US008056982B2

(12) United States Patent
Loney

(10) Patent No.: US 8,056,982 B2
(45) Date of Patent: Nov. 15, 2011

(54) COMPACTABLE, COLLAPSIBLE CHAIR

(76) Inventor: Christopher Loney, Virginia Beach, VA (US)

( * ) Notice: Subject to any disclaimer, the term of this patent is extended or adjusted under 35 U.S.C. 154(b) by 327 days.

(21) Appl. No.: 12/319,244

(22) Filed: Jan. 6, 2009

(65) Prior Publication Data

US 2010/0171341 A1 Jul. 8, 2010

(51) Int. Cl.
*B60N 2/68* (2006.01)
*A47C 4/00* (2006.01)

(52) U.S. Cl. ..... 297/377; 297/16.2; 297/380

(58) Field of Classification Search ..... 297/377, 297/380, 16.2, 17, 391, 16.1, 42, 55, 18, 297/397

See application file for complete search history.

(56) References Cited

U.S. PATENT DOCUMENTS

| | | | | |
|---|---|---|---|---|
| 1,799,939 A | | 4/1931 | Wainewright et al. | |
| 2,570,571 A | | 10/1951 | Leeman | |
| 2,623,574 A | * | 12/1952 | Damsch | 297/380 X |
| 2,663,029 A | | 12/1953 | Whitley et al. | |
| 2,816,599 A | | 12/1957 | Adams | |
| 3,822,424 A | * | 7/1974 | Messer | 297/377 X |
| 4,530,451 A | | 7/1985 | Hamilton | |
| 4,736,825 A | | 4/1988 | Belfi | |
| 5,042,874 A | | 8/1991 | Williams | |
| 5,701,979 A | | 12/1997 | Voich | |
| 6,902,230 B2 | | 6/2005 | Chen | |
| 2004/0195891 A1 | * | 10/2004 | Vaughan | 297/377 |

* cited by examiner

*Primary Examiner* — Anthony D Barfield
(74) *Attorney, Agent, or Firm* — William G. Sykes

(57) ABSTRACT

A collapsible, compactable chair or seating apparatus having a pair of rigid frames hingedly connected to one another to form an A-frame configuration. Both frames may be collapsed so that the frame dimensions of the chair in an operational, deployed configuration may be reduced in two dimensions (i.e., height, length) when collapsed into a compacted configuration for storage or transport. The novel chair may be compacted into a thin bundle that may be rolled up in and contained within fabric forming a portion of the chair. In its compacted, rolled up state, the novel chair is suitable for transportation within a backpack or other such enclosure.

10 Claims, 9 Drawing Sheets

COMPACTABLE, COLLAPSIBLE CHAIR

FIELD OF THE INVENTION

The invention pertains to collapsible seating structures and, more particularly, to a chair having a rigid, collapsible frame having reduced dimensions in a collapsed state allowing the compacted, collapsed chair to be carried in a back pack or the like.

BACKGROUND OF THE INVENTION

Many outdoor activities are greatly enhanced by the use of a portable seat or back support structure. While many such devices have been proposed in the prior art, all suffer from the limitations of bulk and/or weight. While many prior art structures may be folded or collapsed for transportation or storage, the rigid frames thereof retain their original dimensions. Consequently, the frame dimensions of such prior art chairs or seats, even in the folded or collapsed configuration are not reduced and the degree of compaction of such structures is thereby limited. In other words, when such prior art seats are folded or collapsed, they typically retain at least two dimensions (e.g., height and width), of their open, operational dimensions even in their collapsed state. When the activity for which a seat or backrest is required occurs a distance from a transportation source, the collapsed dimensions of prior art structures still present logistical problems due to their bulk when hand carrying them to the site of the activity.

Discussion of the Related Art

Several at attempts at providing portable and/or collapsible seating or backrest structures may be found in the prior art. For example, U.S. Pat. No. 1,799,939 for CONVERTIBLE GROUND SEAT AND LOUNGE, issued Apr. 7, 1931 to Claude Beauchamp Wainwright et al. discloses a portable seating structure collapsible along a single dimension.

U.S. Pat. No. 2,570,571 for COMBINATION BACK REST AND BAG STRUCTURE, issued Oct. 9, 1951 to Robert N. Leeman teaches another portable seating arrangement collapsible along a single dimension.

U.S. Pat. No. 2,816,599 for COMBINATION SUPPORT AND BAG, issued Dec. 17, 1957 to Marjory M. Adams discloses another seat/backrest structure collapsible along a single dimension and having a carrying bag which, in addition to facilitating carrying the ADAMS seat, functions as seat and back support surfaces.

U.S. Pat. No. 4,736,825 for COMBINATION TOTE BAG AND BODY REST, issued Apr. 12, 1988 to Daniel P. Belfi shows another structure collapsible in a single dimension and including an integral tote bag.

U.S. Pat. No. 4,530,451 for COMBINATION BACK PACK/BEACH CHAIR, issued Jul. 23, 1985 to James Hamilton discloses a seat/back rest structure collapsible along a single dimension and having integral straps to facilitate carrying the device on one's back.

U.S. Pat. No. 5,042,874 for FOLDING BEACH LOUNGE, issued Aug. 27, 1991 to Daniel E. Williams teaches another portable seating device collapsible along a single dimension. Extendable portions my be withdrawn to collapse the WILLIAMS device to a predetermined size rectangular parallelepiped, thereby lowering the height as well as the thickness of the lounge, consequently actually allowing compression of structure size along two dimensions.

U.S. Pat. No. 5,701,979 for BAG THAT MAY BE CONVERTED INTO A FOLDING BACK REST FOR THE BEACH OR PARK, issued Dec. 30, 1997 to Jan Harriet Voich teaches a folding structure that may be compacted into an integral carrying bag. However, the structure collapses only along a single dimension.

Published United States Patent Application No. 2004/0195891 for GROUND LOUNGER, published Oct. 7, 2004 upon application by Clifford Eugene Vaughan, provides yet another folding structure, collapsible along a single dimension.

U.S. Pat. No. 6,902,230 for FOLDABLE CHILD SUPPORT DEVICE, issued Jun. 7, 2005 to Shun-Min Chen, provides a structure having frame members foldable at a mid point thereof so as to compact the structure along both height and a length dimensions.

None of the patents and published patent application, taken singly, or in any combination are seen to teach or suggest the novel compactable, collapsible chair of the present invention.

SUMMARY OF THE INVENTION

In accordance with the present invention there is provided a compactable, collapsible seating structure wherein dimensions of the chair in an operational, deployed configuration may be reduced along two dimensions (i.e., height, length into a compacted configuration for storage or transport. The novel chair may be compacted into a thin bundle that is rolled up in and contained within fabric that forms a portion of the chair. In its compacted, rolled up state, the novel chair is suitable for transportation within a backpack or other such enclosure.

It is, therefore, an object of the invention to provide a seating structure convertible from an operational, deployed configuration to a collapsed configuration.

It is another object of the invention to provide a seating structure convertible from an operational configuration to a collapsed configuration wherein both height and length are reduced in the transformation.

It is an additional object of the invention to provide a seating structure having a rigid frame that is convertible from an operational configuration to a collapsed configuration.

It is a further object of the invention to provide a seating structure convertible from an operational configuration to a collapsed configuration having a seat-supporting portion and a back-supporting portion, an angle therebetween being adjustable.

It is a still further object of the invention to provide a seating structure convertible from an operational configuration to a collapsed configuration having a moisture proof mat portion, when in a collapsed configuration the seating structure may be rolled up within the mat portion.

It is yet another object of the invention to provide a seating structure convertible from an operational configuration to a collapsed configuration having frame members foldable at approximately a mid point thereof, the frame members being held in a locked configuration by sliding lock mechanisms.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides compactable, collapsible chair structure having a seat-supporting portion and a back-supporting portion hingedly connected to one another, the angle therebetween being adjustable.

Figure 1:
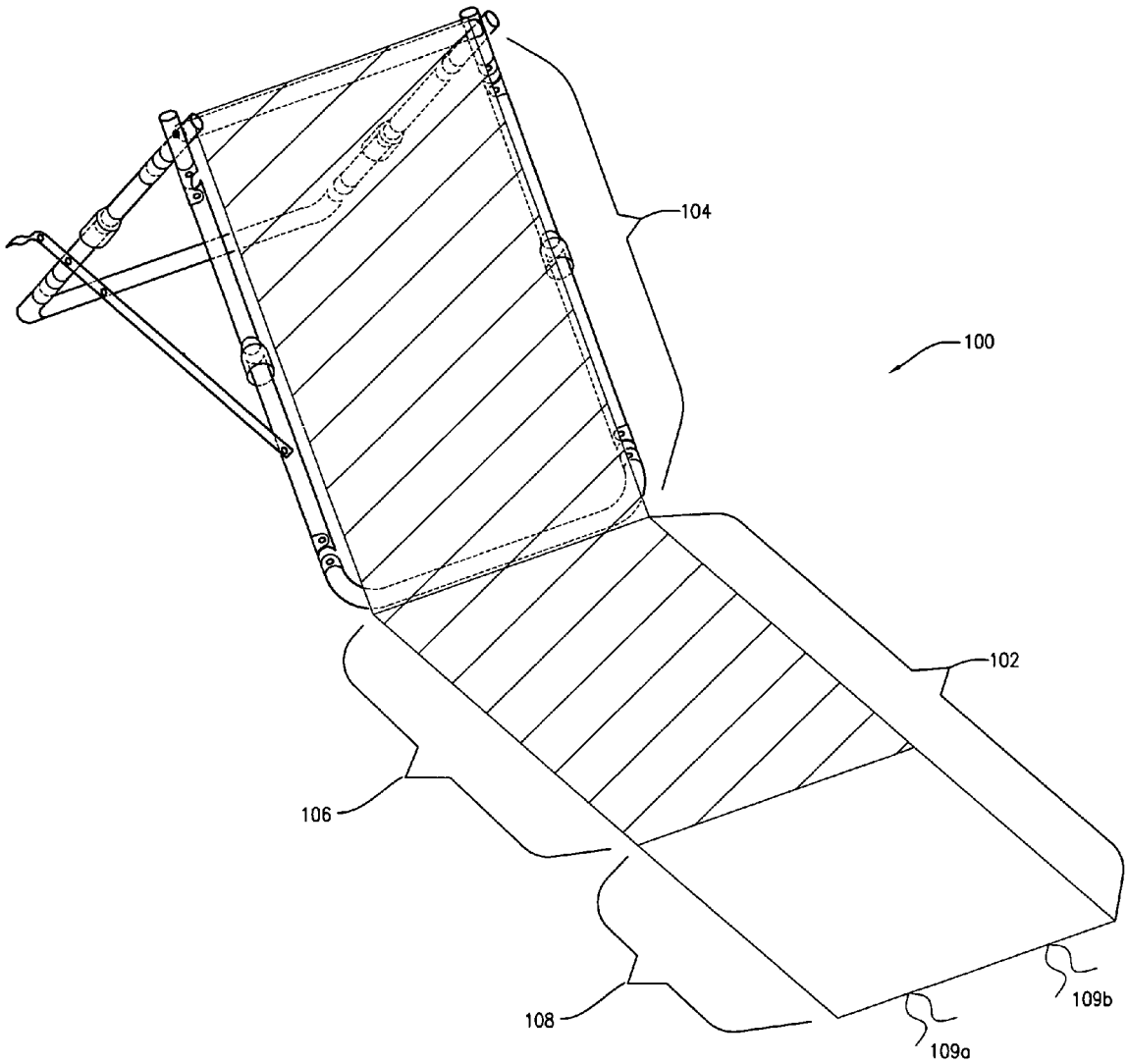
FIG. 1 is a perspective, schematic view of the compactable, collapsible chair or seat in accordance with the invention in an open, operational configuration.

Referring first to FIG. 1, there is shown an isometric view of the compactable, collapsible chair of the present invention in an open, operational configuration, generally at reference number 100.

Figure 2A:
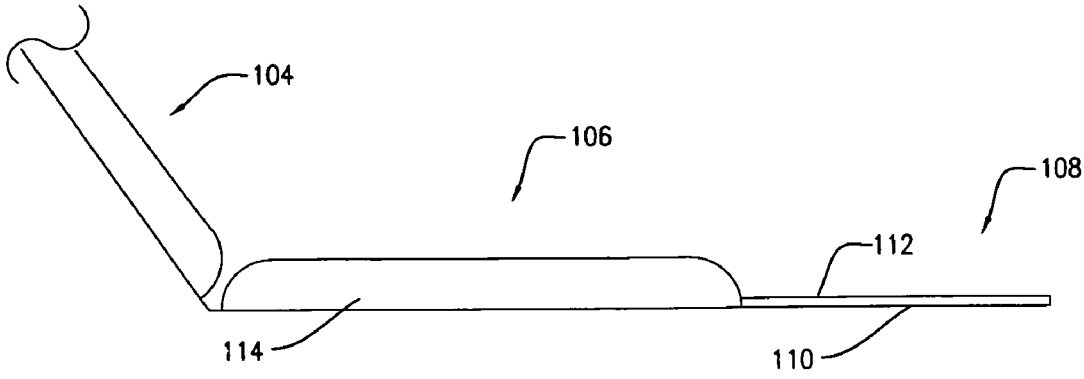
FIGS. 2*a* and 2*b* are side, cross-sectional, schematic views of two embodiments of the seat-supporting and leg-protecting portions of the chair of FIG. 1.
Figure 2B:
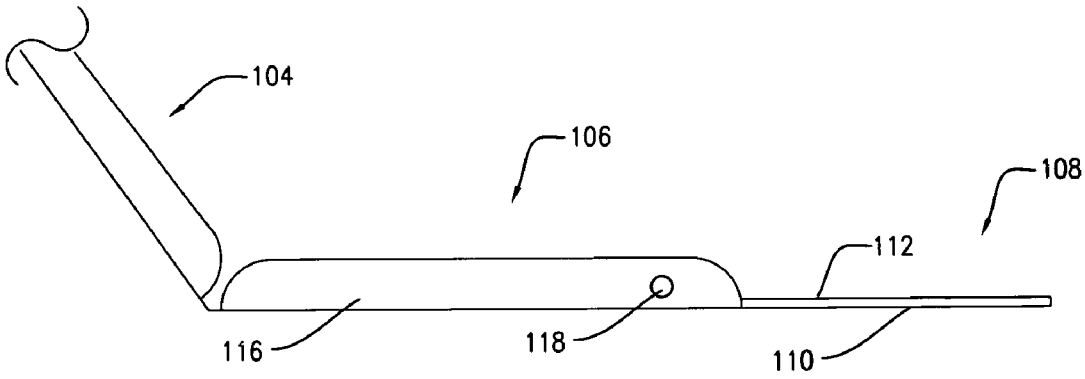

Chair 100 has a seat/leg-supporting portion 102 consisting of a seat-supporting region 106 and a leg-protecting region 108. Referring now also to FIGS. 2*a* and 2*b*, there are shown side, cross-sectional, elevational views of two embodiments of seat/leg supporting region 102 of seat 100.

As seen in FIG. 2*a*, seat-supporting region 106 is typically a padded structure with a moisture barrier, 110 forming a lower, ground-engaging surface. A wear-resistant membrane 112 forms an upper surface of both leg-protecting region 108 and seat supporting region 106. In a first embodiment, seat-supporting region 106 has a foam pad 114 disposed between water-resistant membrane 110 and wear-resistant membrane 112. While a foam pad 114 has been chosen for purposes of disclosure, it will be recognized by those of skill in the art that many alternate materials may be substituted therefor. Consequently, the invention is not considered limited to the foam pad 114 chosen for purposes of disclosure. Rather, the invention comprehends any and all suitable padding materials.

It will be further recognized that while a two-ply structure consisting of moisture resistant membrane 110 and wear-resistant membrane 112 has been shown, a single-ply structure may readily be substituted therefore.

As seen in FIG. 2*b*, an inflatable bladder 116 and an inflation tube and valve 118 replace foam pad 114. The use of an inflatable bladder 116 allows chair 100 to possibly be compacted to a smaller volume than in the embodiment of FIG. 2*a* having foam pad 114. Further, inflatable bladder 116 allows a user to adjust a degree of firmness or support of the "padding" provided thereby to a personal preference. Inflatable bladders 116 and inflation tubes and valve structures 118 are considered to be well known to those of skill in the art and art not further described herein.

A back-supporting portion 104 is hingedly attached to seat/leg supporting region 102 by a continuation of at least wear resistant membrane 112 or back padding 114.

Figure 3A:
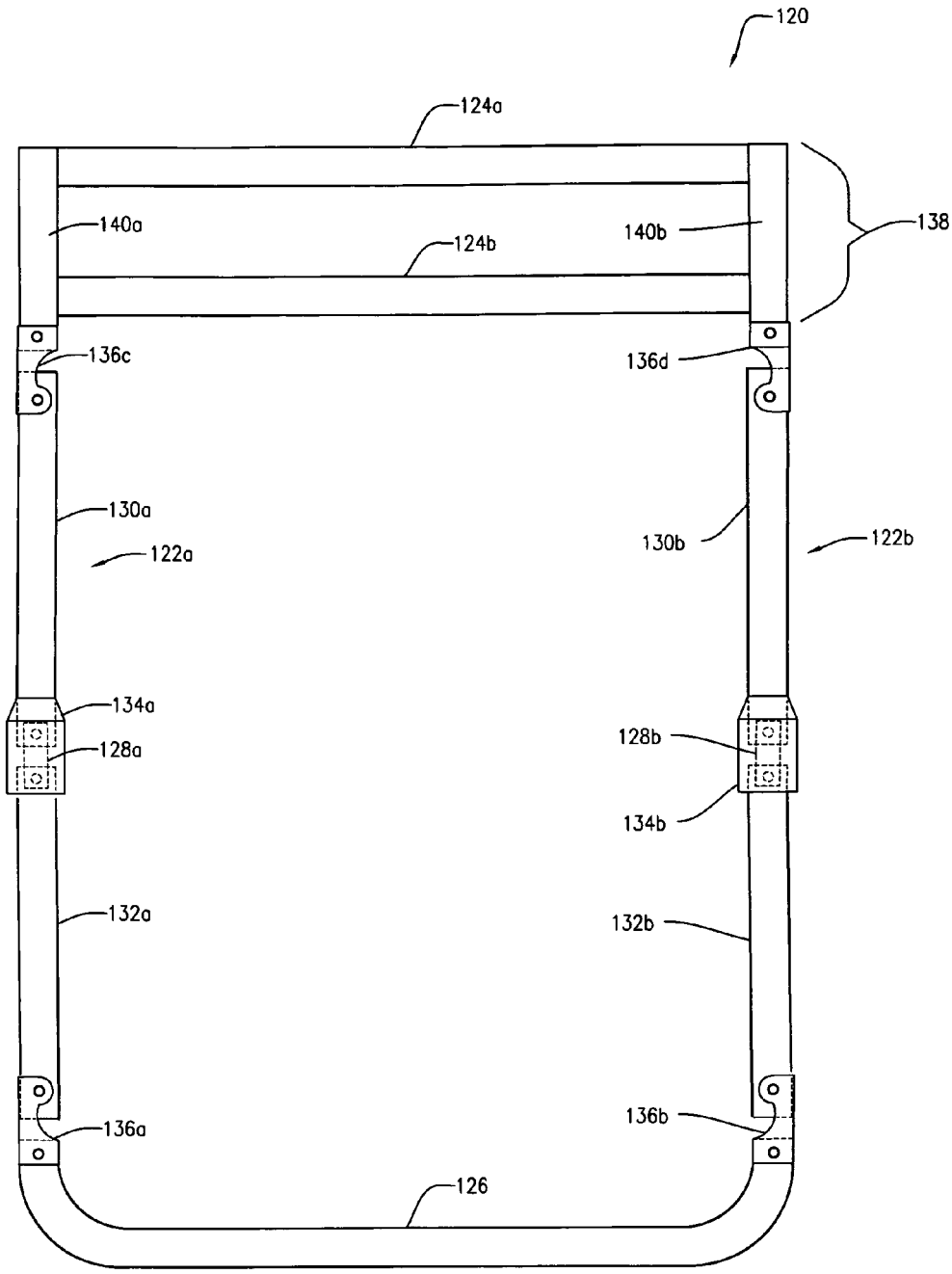
FIGS. 3*a*, 3*b*, and 3*c* are top plan, schematic views of a first frame portion of the chair of FIG. 1 in an open, operational configuration, a partially collapsed configuration, and a fully collapsed configuration, respectively.
Figure 3B:
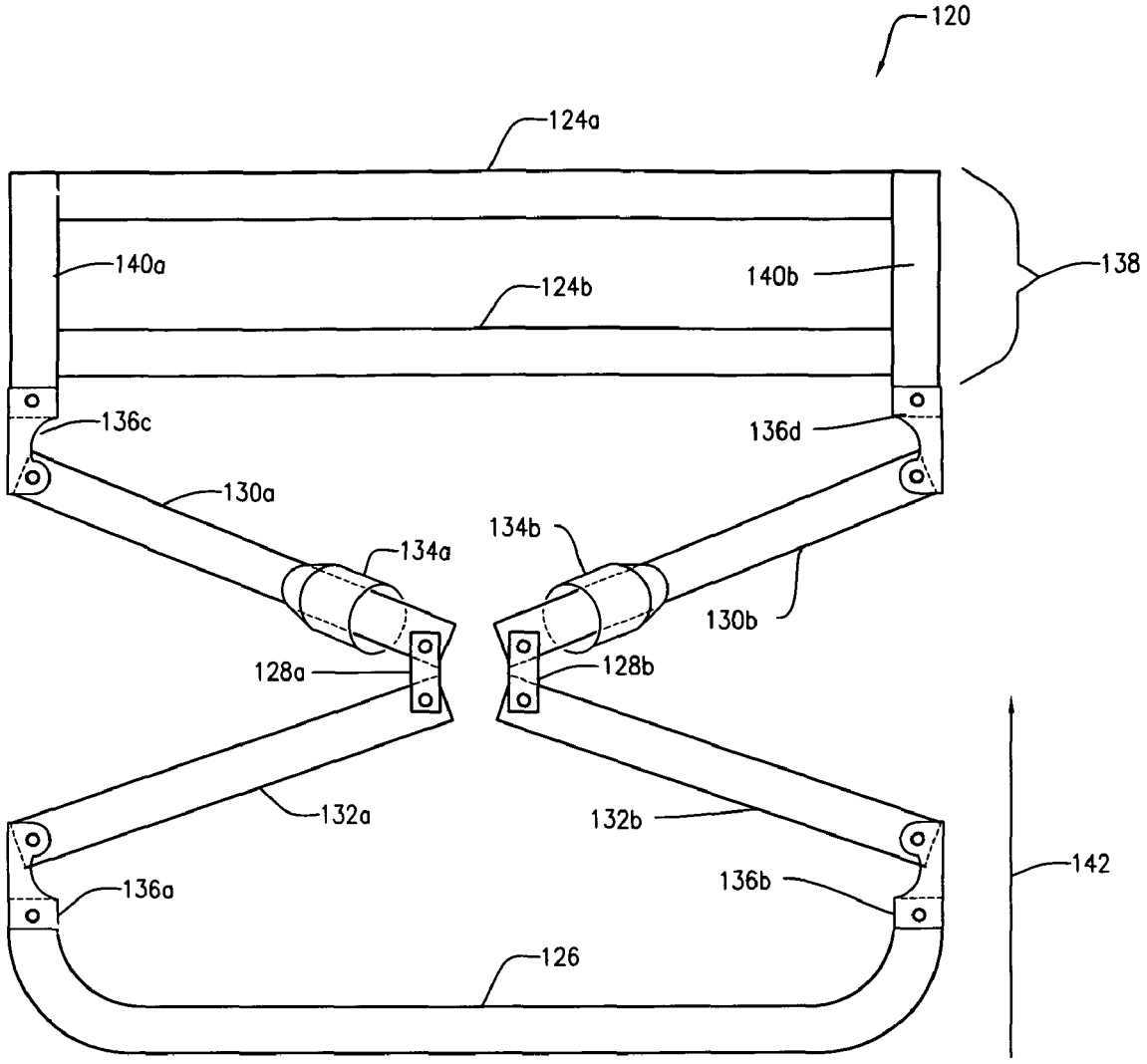

Referring now to FIGS. 3*a* and 3*b*, there are shown top plan, schematic views of a frame 120 in an open, operational configuration, and a partially collapsed configuration, respectively. Frame 120 defines and supports back-supporting portion 104 of chair 100.

In its open, operational configuration (FIG. 3*a*), frame 120 is substantially rectangular having foldable side members 122*a*, 122*b*, top members 124*a*, 124*b*, and a bottom member 126. Foldable side members 122*a*, 122*b* each have a central connector 128*a*, 128*b*, respectively, disposed at approximately a midpoint of respective side members 122*a*, 122*b* along the major axis thereof. Central connectors 128*a*, 128*b* divide respective side members 122*a*, 122*b* into upper segments 130*a*, 130*b* and lower segments 132*a*, 132*b*. Typically, connectors 128*a*, 128*b* bisect respective side members 122*a*, 122*b* causing upper segments 130*a*, 130*b* and lower segments 132*a*, 132*b* to be approximately the same length. It will be recognized that other arrangements may be contemplated wherein by changing the placement of connectors 128*a*, 128*b*, the lengths of upper segments 130*a*, 130*b* may be different than the lengths of lower segments 132*a*, 132*b*. Consequently, the invention is not considered limited to the particular placement of connectors 128*a*, 128*b* along side members 122*a*, 122*b*, respectively. It will be recognized that upper segments 130*a*, 130*b* and lower segments 132*a*, 132*b* form respective continuous members when respective slide locks 134*a*, 1134*b* are in place.

Slidable locks 134*a*, 134*b* are selectively positionable along side members 122*a*, 122*b*, respectively, to secure upper segments 130*a*, 130*b* and lower segments 132*a*, 132*b* in a substantially linear orientation when frame 120 is in its open, operational configuration. An end view of slidable locks 134*a* and 234*b*.

Corner hinges 136*a*, 136*b*, connect distal ends of lower segments 132*a*, 132*b* to lower member 126. Likewise, corner hinges 136c, 136d connect distal ends of upper segments 130*a*, 130*b* to an upper frame brace 138. Upper frame brace 138 consists of top frame members 124*a*, 124*b* and frame brace side members 140*a*, 140*b*. Corner hinge arrangements are considered to be well known to those of skill in the art and, consequently, are not further discussed herein. Any suitable hinge arrangement may be used throughout the novel folding chair 100 and the invention is not limited to the hinge arrangement chosen for purposes of disclosure.

FIG. 3*b* shows frame 120 in a partially collapsed configuration. Slide locks 134*a*, 134*b* are shown displaced from connectors 128*a*, 128*b*, thereby allowing upper segments 130*a*, 130*b* and lower segments 132*a*, 132*b* to move inwardly, thereby moving lower frame member 126 upwardly toward upper frame brace 138 in the direction indicated by arrow 142.

Figure 3C:
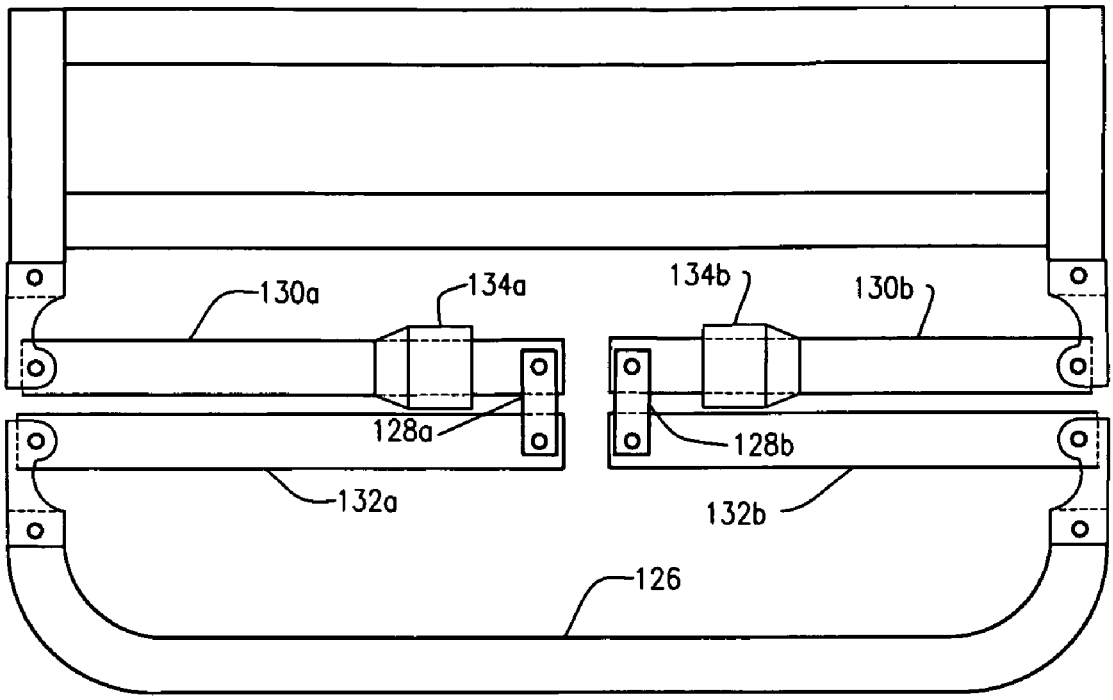
Figure 3D:
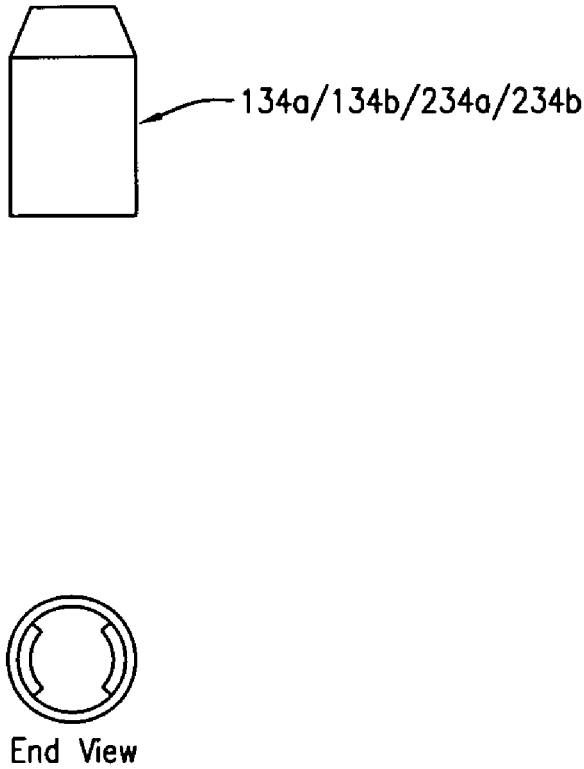
FIG. 3*d* is an end view of a slide lock included in the chair portions of FIGS. 3*a*, 3*b*, and 3*c;*

Referring now also to FIG. 3*c*, frame 120 is shown in a fully collapsed configuration.

Figure 4A:
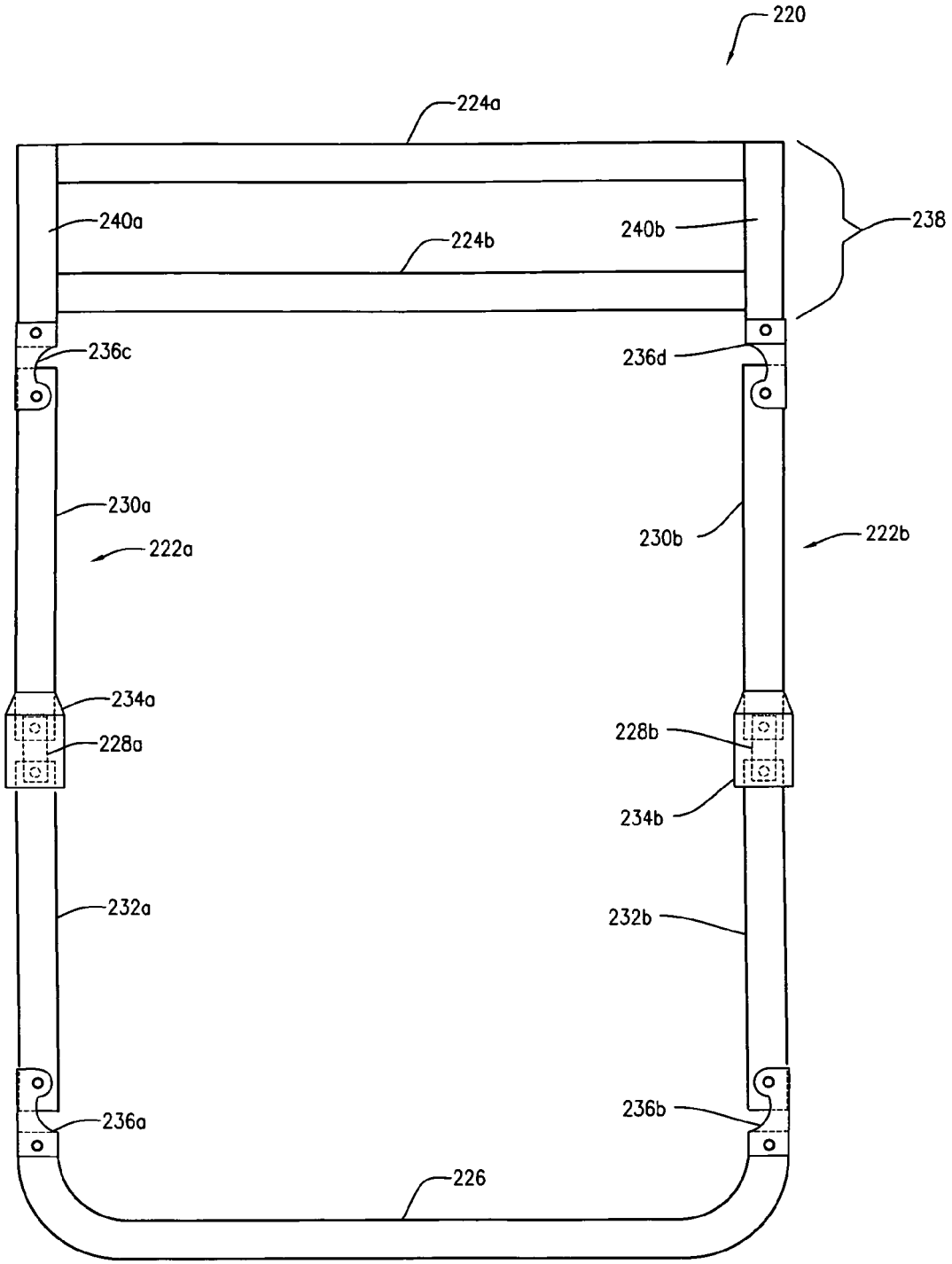
FIGS. 4*a* and 4*b* are top plan, schematic views of a second frame portion of the chair of FIG. 1 in an open, operational configuration, and a partially collapsed configuration, respectively.
Figure 4B:
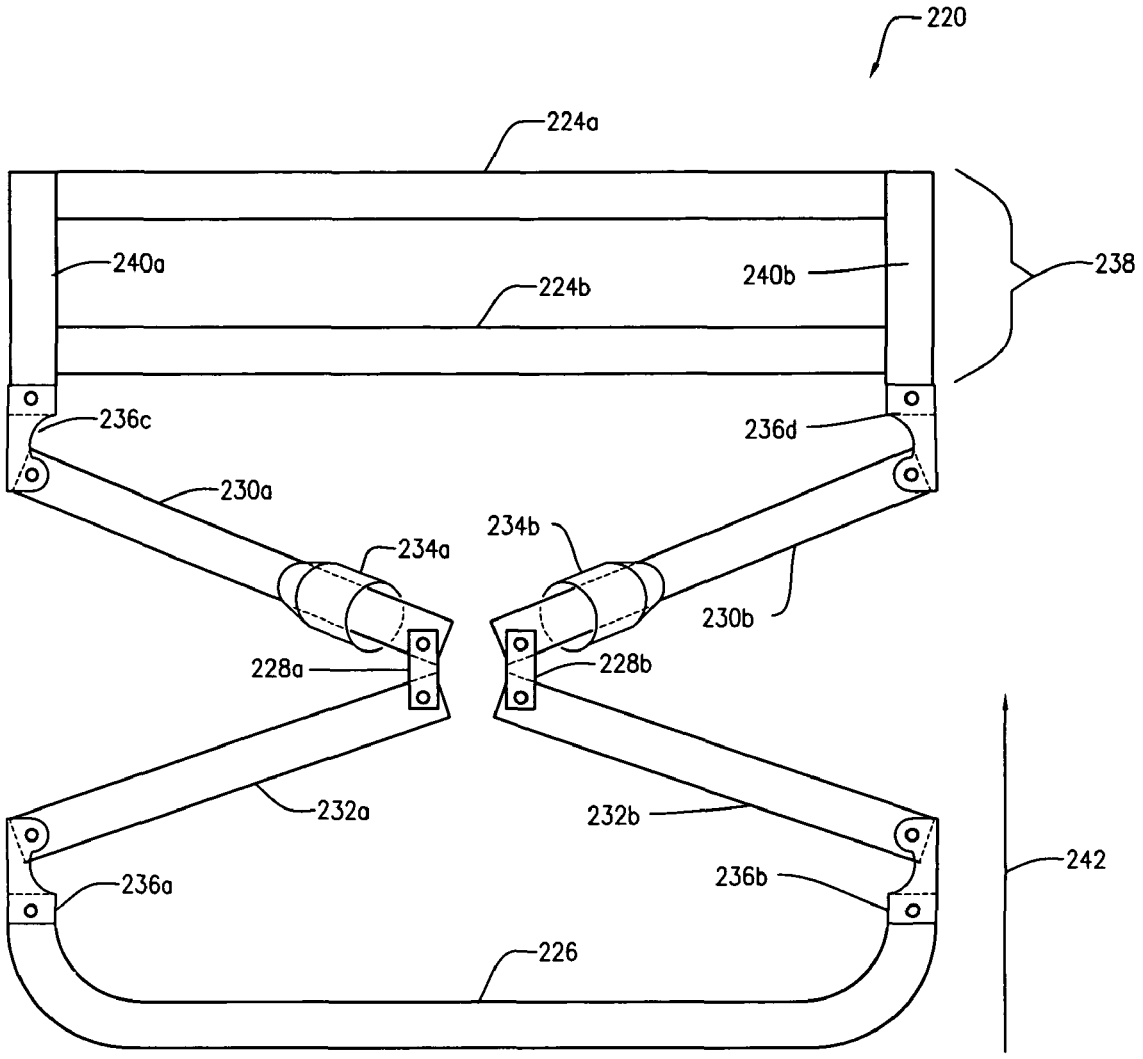

Referring now to FIGS. 4*a* and 4*b*, there are shown top plan, schematic views of a vertical support frame 220 in an open, operable configuration and in a partially collapsed configuration, respectively. Vertical support frame 220 is similar in both construction and operation to frame 120 (FIGS. 3*a*-3*c*) discussed in detail hereinabove.

In its open, operational configuration (FIG. 4*a*), frame 220 is also substantially rectangular having foldable side members 222*a*, 222*b*, top members 224*a*, 224*b*, and a bottom member 226. Foldable side members 222*a*, 222*b* each have a central connector 228*a*, 228*b* disposed at approximately a midpoint of respective side members 222*a*, 222*b* along the major axis thereof. Central connectors 228*a*, 228*b* divide respective side members 222*a*, 222*b* in to upper segments 230*a*, 230*b* and lower segments 232*a*, 232*b*. Typically, connectors 228*a*, 228*b* bisect respective side members 222*a*, 222*b* causing upper segments 230*a*, 230*b* and lower segments 232*a*, 232*b* to be substantially the same length. It will be recognized that other arrangements may be contemplated wherein by changing the placement of connectors 228*a*, 228*b*, the lengths of upper segments 230*a*, 230*b* may be different than the lengths of lower segments 232*a*, 232*b*. Consequently, the invention is not considered limited to the particular placement of connectors 228*a*, 228*b* along side members 222*a*, 222*b*, respectively.

Slidable locks 234*a*, 234*b* are selectively positionable along side members 222*a*, 222*b*, respectively, to secure upper segments 230*a*, 230*b* and lower segments 232*a*, 232*b* in a substantially linear orientation when frame 220 is in its open, operational configuration.

Corner hinges 166*a*, 166*b*, connect distal ends of lower segments 232*a*, 232*b* to lower member 226. Likewise, corner hinges 166c, 166d connect distal ends of upper segments 230*a*, 230*b* to upper frame members 224*a*, 224*b*.

FIG. 4*b* shows frame 220 in a partially collapsed configuration. Slide locks 234*a*, 234*b* are shown displaced from connectors 228*a*, 228*b*, thereby allowing upper segments 230*a*, 230*b* and lower segments 232*a*, 232*b* to move inwardly, thereby moving lower frame member 226 upwardly toward upper frame members 224*a*, 224*b*.

Figure 5:
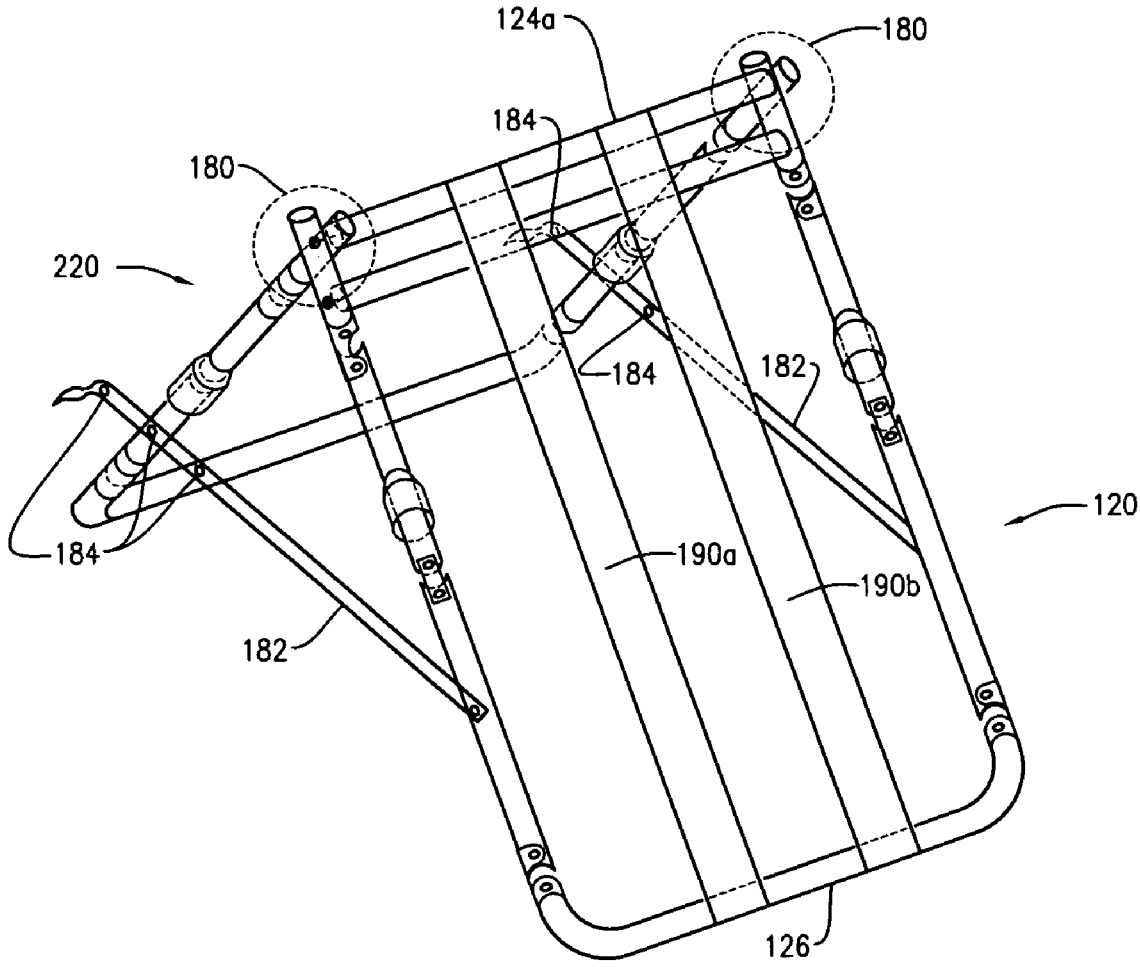
FIG. 5 is a perspective, schematic view of the first and second frame portions of the chair of FIG. 1 hingedly connected to one another.

Referring now to FIG. 5, there is shown a perspective, schematic view of frames 120 and 220 rotatably interconnected into the A-frame structure that forms the complete frame of the novel chair 100. Pivotable interconnections are shown schematically at reference numbers 180. It will be recognized that numerous mechanisms are known to those of skill in the art for pivotably interconnecting frames 120 and 220. Such mechanisms include, but are not limited to, detented mechanism capable of self-locking frames 120 and 220 in discrete, predetermined angular relationships to one another. Such mechanisms are not further described herein.

Flexible straps, typically having one or more grommets 184 may be used to secure the angular relationship of frames 120 and 220.

Other flexible straps 190*a*, 190*b* are typically fastened to top frame member 224*a* and bottom frame member 126. Flexible straps 190*a*, 190*b* provide back support to a user of chair 100.

Refer now again also to FIGS. 3*a*-3*c* and FIGS. 4*a*-4*b*. In operation, compactable, collapsible chair 100 may be transformed from an operational configuration to a collapsed configuration by first unfastening straps 182.

If the chair 100 configuration includes an inflatable bladder 116 (FIG. 2*b*), it may be necessary to deflate inflatable bladder 116 prior to unfastening straps 182.

Slidable locks 134*a*, 134*b*, 234, 234*b* on frames 120 and 220, respectively, are unlocked and slid away from connectors 128*a*, 128*b*, 228*a*, 228*b*, respectively.

Frame members 130*a*, 130*b*, 132*a*, 132*b* of frame 120 and 230*a*, 230*b*, 232*a*, 232*b* of frame 220 may be pushed inwardly (toward the center of respective frames 120 and 220) until the frames are totally collapsed.

Once collapsed, the compacted structure may be rolled up in the moisture proof barrier 110 (FIGS. 2*a*, 2*b*) into a configuration suitable for carrying in a backpack or other such container.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A collapsible, compactable chair comprising:

a) a first collapsible, substantially rectangular frame having a top member, a proximal end of a collapsible right side member hingedly connected to a first end thereof, and a proximal end of a collapsible left side member hingedly connected to an opposing end thereof, and a bottom member having a first end hingedly connected to a distal end of said collapsible left side member and an opposing end hingedly connected to a distal end of said collapsible right side member, said first frame being movable between an open, operational configuration and a collapsed configuration, each of said collapsible left side member and said collapsible right side member having a hinge disposed proximate a respective midpoint along a respective major axis thereof;

b) a second collapsible, substantially rectangular frame having a top member, a proximal end of a collapsible right side member hingedly connected to a first end thereof, and a proximal end of a collapsible left side member hingedly connected to an opposing end thereof, and a bottom member having a first end hingedly connected to a distal end of said collapsible left side member and an opposing end hingedly connected to a distal end of said collapsible right side member, said second frame being movable between an open, operational configuration and a collapsed configuration, each of said collapsible left side member and said collapsible right side member having a hinge disposed proximate a respective midpoint along a respective major axis thereof;

c) means for rotatively interconnecting said first frame and said second frame operatively connected to said first frame and said second frame proximate respective top members of said first frame and said second frame, said first frame and said second frame thereby defining an A-frame structure having an acute angle between major planes formed by said first frame and said second frame; and d) a membrane covering at least said first collapsible, substantially rectangular frame and said second collapsible, substantially rectangular frame.

2. The collapsible, compactable chair as recited in claim 1, wherein said collapsible right side member of said first frame and said collapsible right side member of said second frame member remain substantially coplanar, regardless of a value of said acute angle between said first frame and said second frame when both said first frame and said second frame are in said open operational configurations.

3. The collapsible, compactable chair as recited in claim 1, wherein said means for rotatively interconnecting said first frame and said second frame comprises a detented mechanism.

4. The collapsible, compactable chair as recited in claim 1, further comprising:

e) at least one strap adjustably affixed to at least one of the group: said collapsible right member of said first frame and said collapsible right member of said second frame, and said collapsible left member of said first frame and said collapsible left member of said second frame.

5. The collapsible, compactable chair as recited in claim 4, wherein said at least one strap comprises a grommet disposed therein.

6. The collapsible, compactable chair as recited in claim 1, wherein said membrane includes at least one selected from the group: a waterproof fabric, a wear-resistant fabric, and a pad.

7. The collapsible, compactable chair as recited in claim 6, wherein said pad comprises an inflatable pad.

8. The collapsible, compactable chair as recited in claim 6, wherein said first frame comprises a back-supporting frame and said membrane extends beyond said lower member thereof.

9. The collapsible, compactable chair as recited in claim 1, further comprising:

e) at least one flexible strap disposed between said top member and said bottom member of said first collapsible, substantially rectangular frame.

10. A collapsible, compactable chair comprising:

a) a first collapsible, substantially rectangular frame having a top member, a proximal end of a collapsible right side member hingedly connected to a first end thereof, and a proximal end of a collapsible left side member hingedly connected to an opposing end thereof, and a bottom member having a first end hingedly connected to a distal end of said collapsible left side member and an opposing end hingedly connected to a distal end of said collapsible right side member, said first frame being movable between an open, operational configuration and a collapsed configuration, each of said collapsible left side member and said collapsible right side member having a hinge disposed proximate a respective midpoint along a respective major axis thereof;

b) a second collapsible, substantially rectangular frame having a top member, a proximal end of a collapsible right side member hingedly connected to a first end thereof, and a proximal end of a collapsible left side member hingedly connected to an opposing end thereof, and a bottom member having a first end hingedly connected to a distal end of said collapsible left side member and an opposing end hingedly connected to a distal end of said collapsible right side member, said second frame being movable between an open, operational configuration and a collapsed configuration, each of said collapsible left side member and said collapsible right side member having a hinge disposed proximate a respective midpoint along a respective major axis thereof;

c) detented means for rotatively interconnecting said first frame and said second frame operatively connected to said first frame and said second frame proximate respective top members of said first frame and said second frame, said first frame and said second frame thereby defining an A-frame structure having an acute angle between major planes formed by said first frame and said second frame, said collapsible right side member of said first frame and said collapsible right side member of said second frame member remaining substantially coplanar, regardless of a value of said acute angle between said first frame and said second frame when both said first frame and said second frame are in said open operational configurations;

d) a membrane selected from the group: a waterproof fabric, a wear-resistant fabric, and a pad covering at least said first collapsible, substantially rectangular frame and said second collapsible, substantially rectangular frame, said membrane extending beyond said lower member of said first frame; and e) at least one strap adjustably affixed to at least one of the group: said collapsible right member of said first frame and said collapsible right member of said second frame, and said collapsible left member of said first frame and said collapsible left member of said second frame, said flexible strap comprising at least one grommet disposed therein.

* * * * *